US006062293A

United States Patent [19]

Berger, Jr.

[11] Patent Number: 6,062,293

[45] Date of Patent: May 16, 2000

[54] GARAGE DOOR REINFORCEMENT AND METHOD

[76] Inventor: Allen Berger, Jr., 12195 NW. 98 Ave., Hialeah Gardens, Fla. 33018

[21] Appl. No.: 09/360,177

[22] Filed: Jul. 23, 1999

Related U.S. Application Data

[63] Continuation of application No. 09/072,210, May 4, 1998, abandoned.

[51] Int. Cl.[7] ..... E06B 3/48

[52] U.S. Cl. ..... 160/229.1; 160/236; 52/801.12

[58] Field of Search ..... 160/201, 229.1, 160/232, 236, 405; 52/801.12, 801.11, 784.12, 784.13

[56] References Cited

U.S. PATENT DOCUMENTS

| | | | |
|---|---|---|---|
| 2,993,572 | 7/1961 | Rich | 160/229.1 |
| 3,740,916 | 6/1973 | Kenaga | 160/201 X |
| 3,891,021 | 6/1975 | Geoffrey | 160/201 X |
| 4,641,469 | 2/1987 | Wood | 52/801.12 X |
| 5,027,494 | 7/1991 | Martin | 160/201 X |
| 5,555,923 | 9/1996 | Leist et al. | 160/229.1 |
| 5,706,877 | 1/1998 | Grisham et al. | 160/201 |
| 5,749,407 | 5/1998 | Brenner et al. | 160/201 X |

*Primary Examiner*—David M. Purol
*Attorney, Agent, or Firm*—J. Sanchelima

[57] ABSTRACT

Reinforcements for the horizontal lateral edges of a garage door panel, which have been reverse folded to a J-shaped section, provide a neat channel for nesting a reinforced bar, such as an extrusion. One such extrusion, being C-shaped in cross-section, provides space for the off-setting adjoining female member of the lateral edge. At the other longitudinal side, a rectangular channel or extrusion can be similarly nestled into the J-shaped cross-section. The vertical ends and the vertical reinforcing truss provided at various stations have a similar C-shaped recess, and an extruded channel positioned in the same recess will cause every single panel of the door to have a plurality of reinforcing frames at every location where intercepting members appear. Desirably, the reinforcing members are secured in place of cementaceous material to thereby avoid the unsightly appearance of a pop rivet or other fastener.

3 Claims, 9 Drawing Sheets

GARAGE DOOR REINFORCEMENT AND METHOD

This is a Continuation application Ser. No. 09/072,210, filed on May 4, 1998 now abandoned.

FIELD OF THE INVENTION

The present invention relates to garage doors of multiple panels, normally such panels are of various width, with a height of approximately 21 inches and modular lengths of 8, 9, 12, 16 feet. The four panels are monolithic throughout the entire length, each having a lateral edge top and bottom, which is either a tongue or groove. The tongues and grooves being purported for making mounting wheels on a vertical track which is curvilinear at its upper portion to engage a horizontal track extension for storage in the raised position extension when the door is raised. The doors are equally manual operated or motor driven. The panels also have vertical reinforcements comparable, usually equally spaced, along the length of the panel and extending from top to bottom. The horizontal edges, however, are not reinforced. As a result of the subject design, while the doors operate efficiently and effectively in good weather, they are prone to damage by the vehicles which they house. Most importantly the doors are not pre-stressed to withstand the type of winds experienced in many parts of the world. This is particularly true in areas which are prone to hurricanes, or even mid-winter winds in the plains areas where the winds can achieve the same velocity as hurricane force, namely 75 miles per hour. There is an immediate need for reinforced garage doors, be it single, double or three car occupancy, which would pass the hurricane standards, such as those established by Dade County, Florida, Southeast Builders Association, and the like.

SUMMARY OF THE INVENTION

The present invention derives from the discovery that the horizontal lateral edges of a garage door panel, which have been reverse folded to a J-shaped section, provide a neat channel for nesting a reinforced bar, such as an extrusion. One such extrusion, being C-shaped in cross-section, provides space for the off-setting adjoining female member of the lateral edge. At the other longitudinal side, a rectangular channel or extrusion can be similarly nod into the J-shaped cross-section. The vertical ends and the vertical reinforcing truss provided at various stations have a similar C-shaped recess, and an extruded channel positioned in the same recess will cause every single panel of the door to have a plurality of reinforcing frames at every location where intercepting members appear. Desirably, the reinforcing members are secured in place by means of cementaceous material to thereby avoid the unsightly appearance of a pop rivet or other fastener. The method of the invention looks to the sequential steps of securing the reinforcing members in a garage door or, alternatively, forming the same into a kit which "Joe Home Owner" can purchase at his builder's supply store, take home, and install in a matter of few hours. Thus, a Home Owner can retrofit his garage door into a garage door which is significantly stronger, resists wind blasts and damage to a considerably enhanced degree in contradistinction with the pre-existing condition. One embodiment for such retrofit is that the reinforced extrusion is notched onto one lateral edge to bypass through any bolts or nuts that penetrate the channel area on the lateral edges.

In view of the foregoing, it is a principal object of the present invention to provide a reinforced garage door which is made from standard sized panels, to fit standard sized tracks, in standard sized garages, and yet effective to withstand wind blows of hurricane force velocity.

A further more important object of the invention is to provide such reinforced means for a manufactured door, or a retrofit door, which are cost effective, simple to install, and readily replaceable in the event of damage to various components of the door.

A further object of the present invention is inherent to the structure of the reinforcing member which permits a simplified kit to be offered to the Home Owner, pre-cut to his particular door width.

DESCRIPTION OF THE ILLUSTRATIVE DRAWINGS

Further objects and advantages of the subject garage door reinforcement will become apparent as the following description of the illustrative drawings will take place, in conjunction with the attached drawings in which.

Figure 8A:
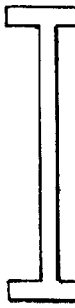
Figure 8B:
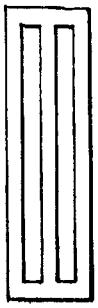
Figure 8C:
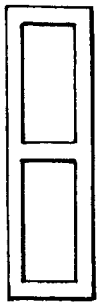
Figure 8D:
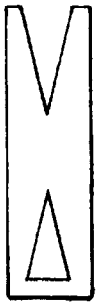
Figure 8E:
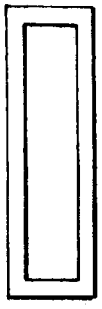
Figure 8F:
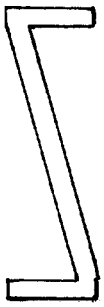
Figure 8G:
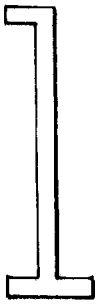
Figure 8H:
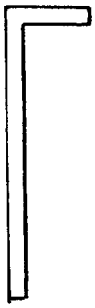
Figure 8I:
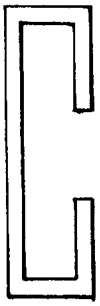
Figure 8J:
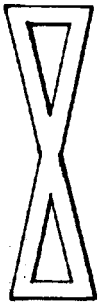
Figure 8K:
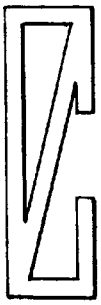
Figure 8L:
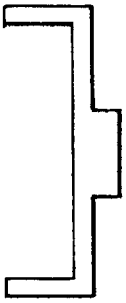
Figure 8M:
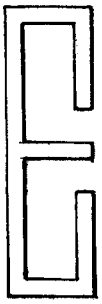
Figure 8N:
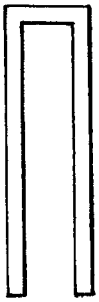
Figure 8O:
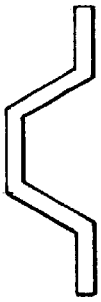
Figure 8P:
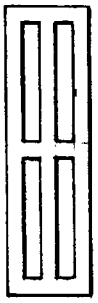
Figure 8Q:
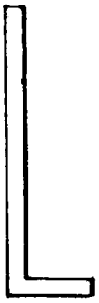
Figure 8R:
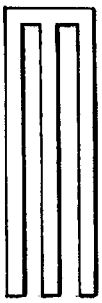
Figure 8S:
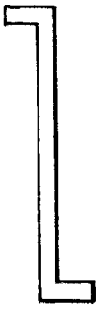
Figure 8T:
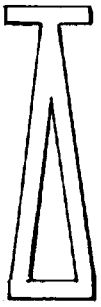
Figure 8V:
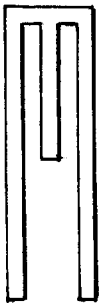
Figure 8W:
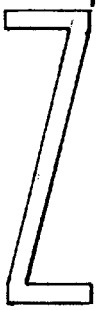
Figure 9:
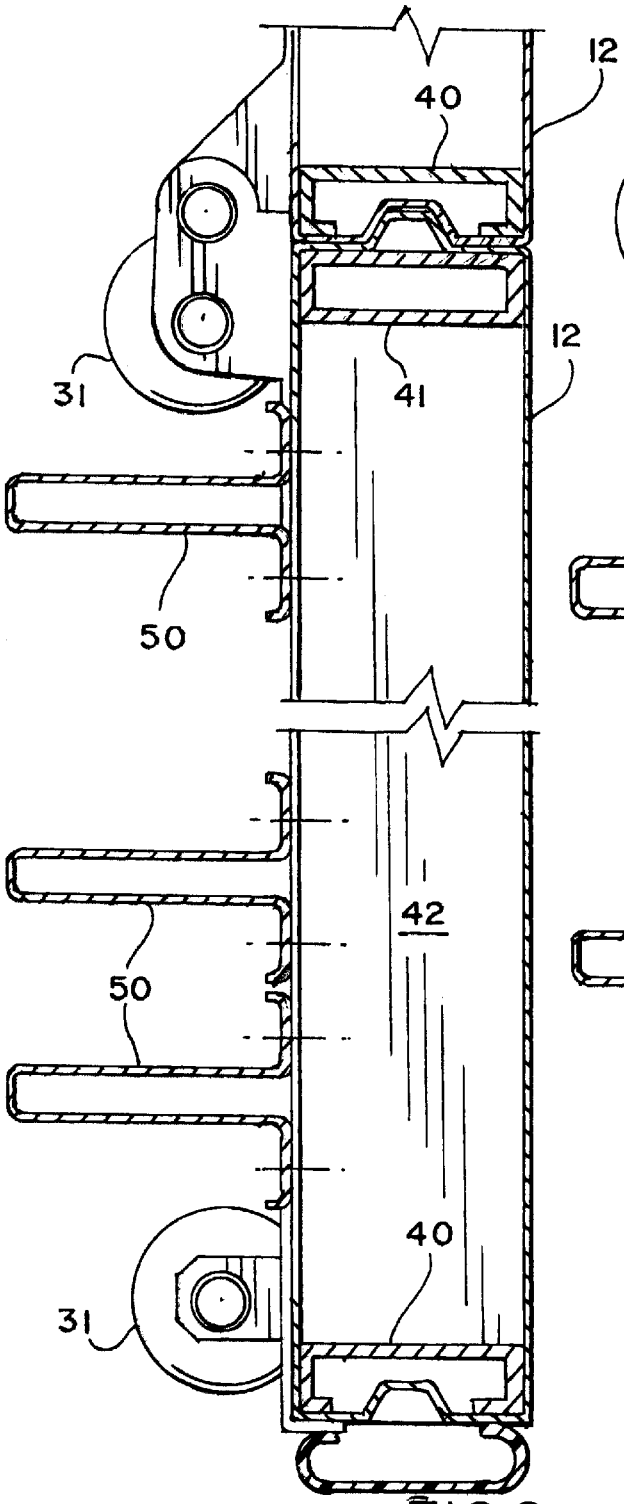
Figure 10:
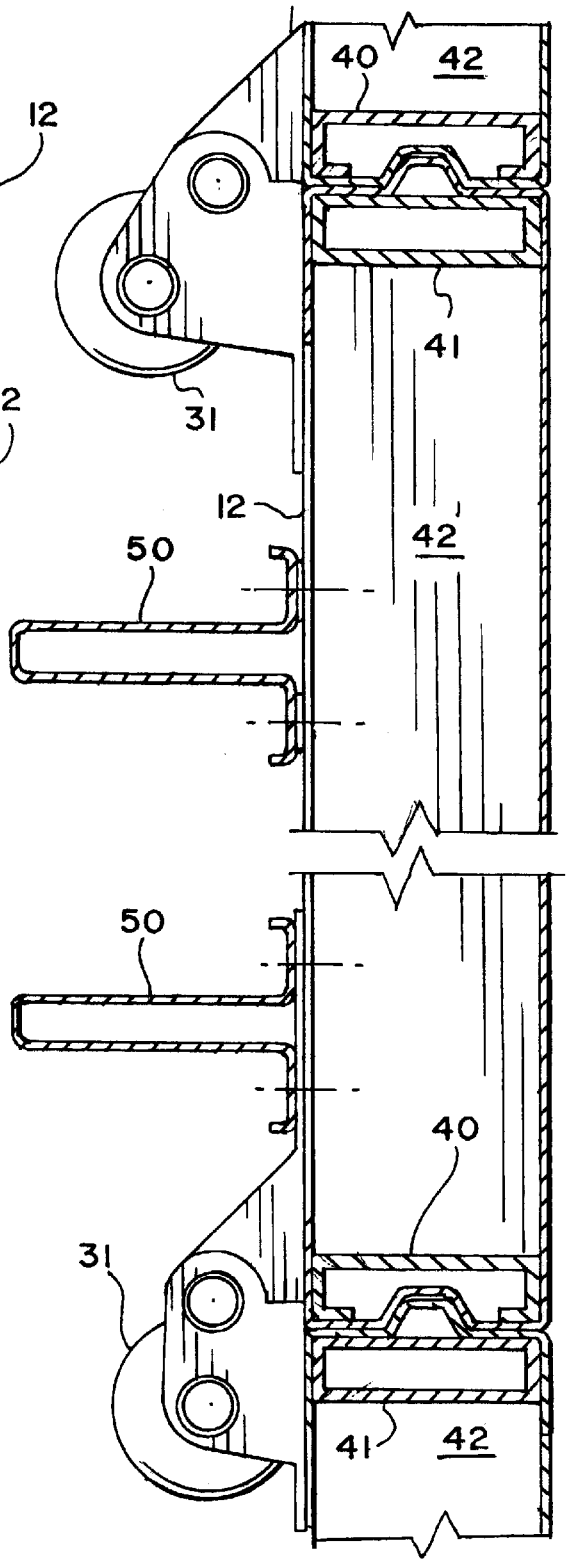
Figure 11:
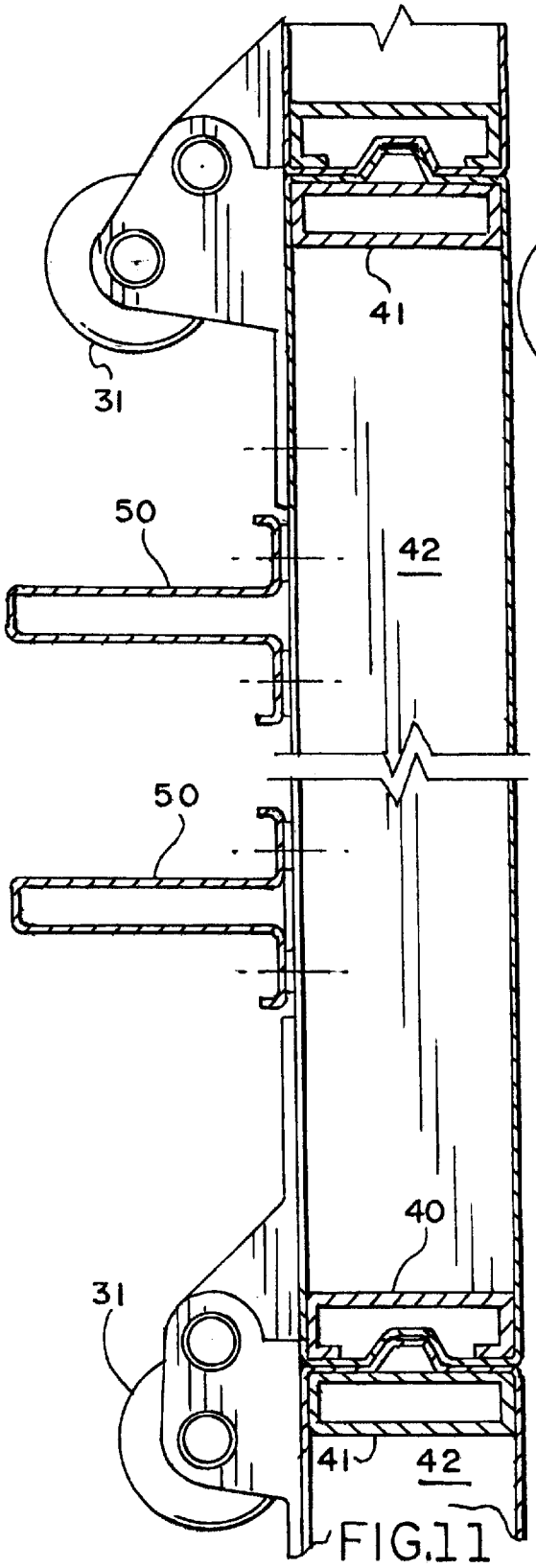
Figure 12:
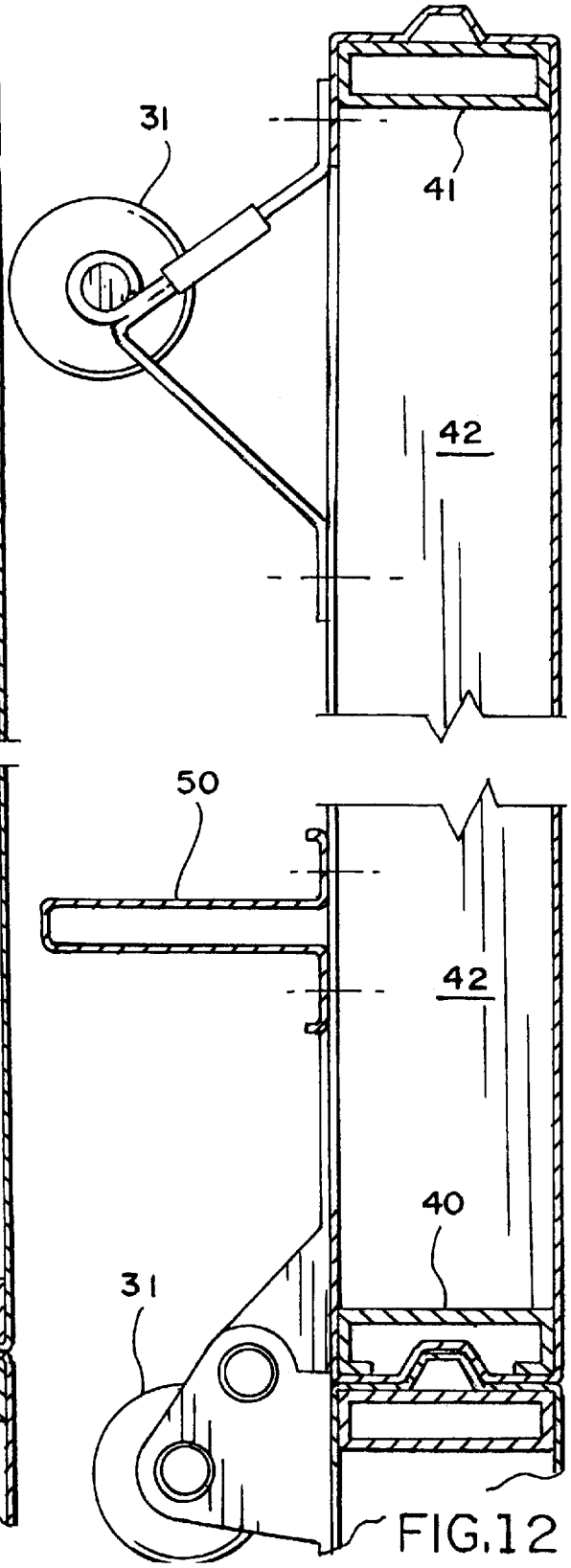
Figure 13:
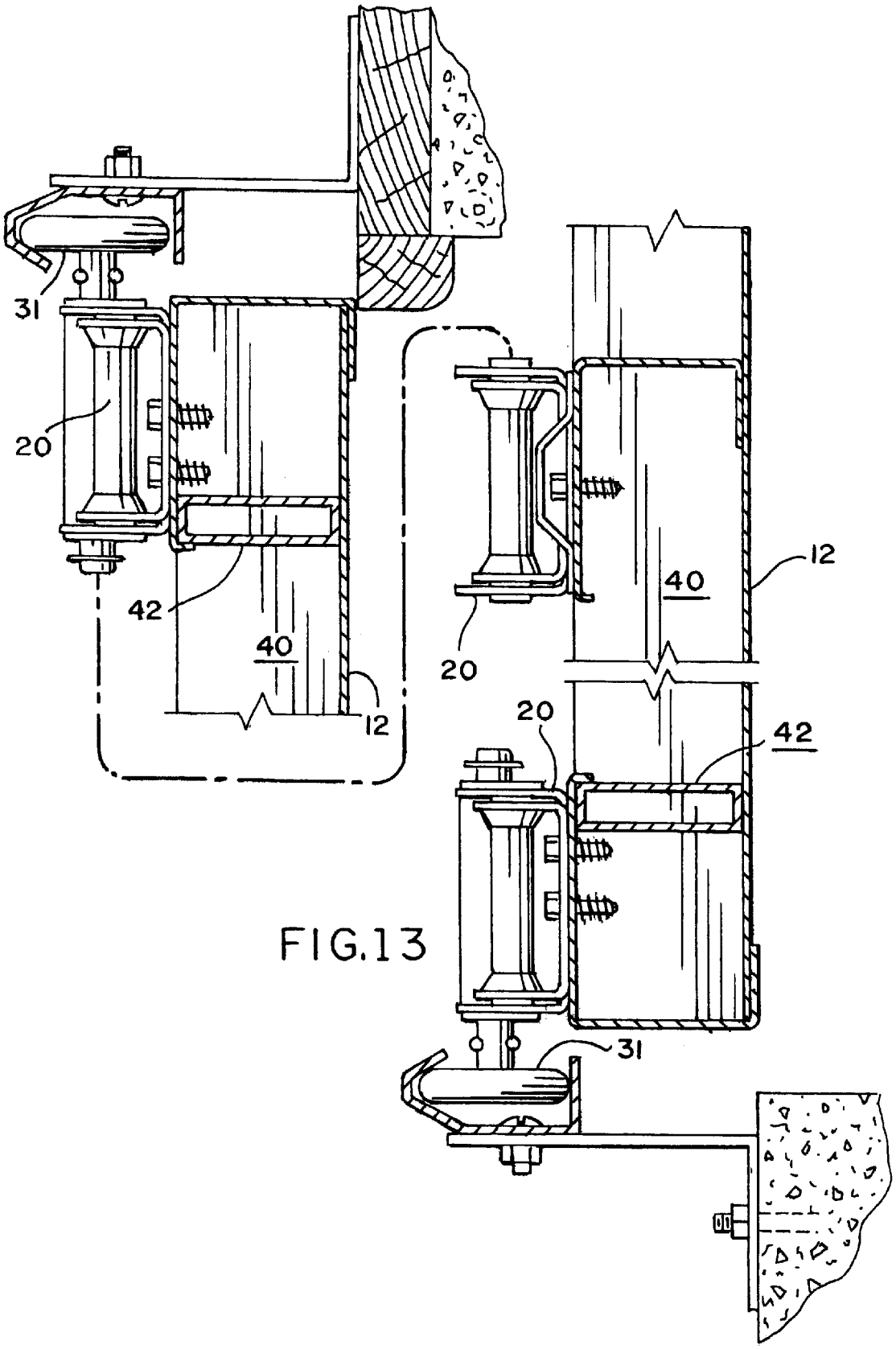
Figure 14A:
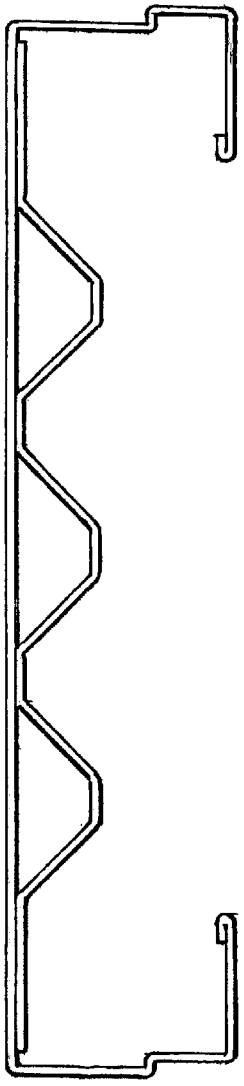
Figure 14B:
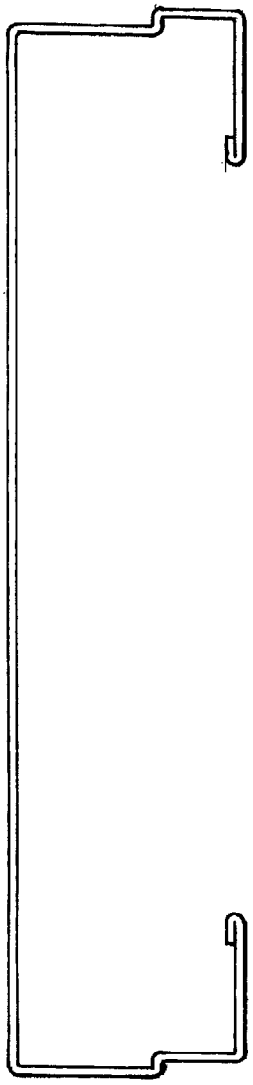
Figure 15A:
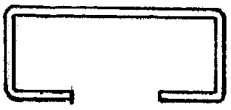
Figure 15B:
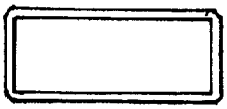
Figure 15C:
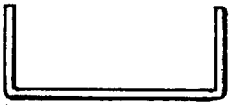
Figure 15D:
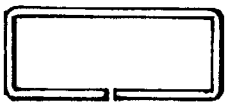

FIGS. 8*a–w* show various cross-sections for the extruded reinforcing bars;

FIG. 9 discloses a bottom section of the door with the reinforcing trusses applied to the bottom section 12;

FIG. 10 shows two reinforcing trusses applied to the second section;

FIG. 11 shows the application of the reinforcing trusses to the third and fourth sections;

FIG. 12 shows the reinforcing truss applied to the top section;

FIG. 13 shows an enlarged transverse sectional view of the lateral edge of the subject door including a reinforcing bar 42;

FIGS. 14*a, b* and *c* show alternative cross-sections of the door panel itself, particularly introducing a roll formed concept with an interlock as in FIG. 14*b*; and FIGS. 15*a, b, c* and *d* show roll formed reinforcing bars as distinguished from the extruded reinforcing bars shown in FIGS. 8*a* through 8*w*.

DESCRIPTION OF PREFERRED EMBODIMENTS

Figure 1:
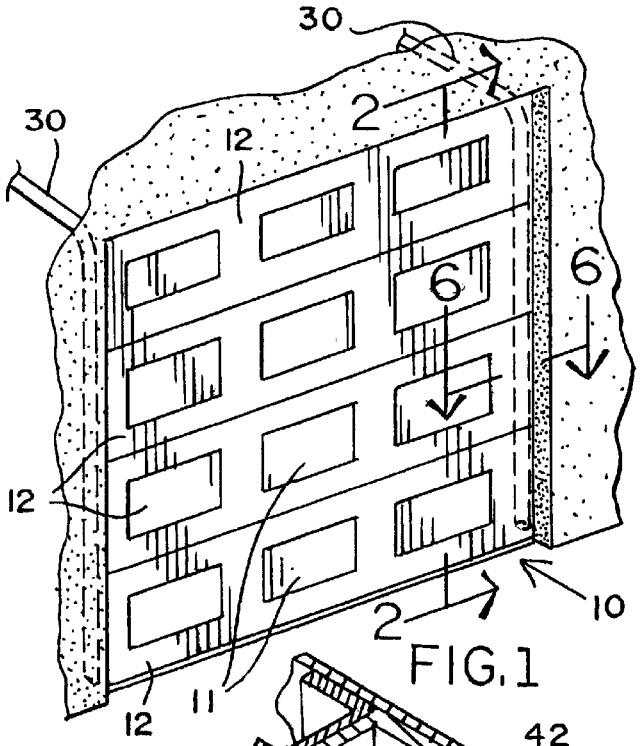
FIG. 1 is a front perspective view of an electric garage door showing, in phantom lines partly broken, the interior portion and the track.

The present invention is best understood as it applies to an actual door 10, shown in FIG. 1 on the typical garage. The door 10 is made up of a plurality of raised panels 11 which together make a single section 12 that runs the entire width of the door. Tongue upper runners 14 are on the top of each panel and groove lower runners 15 are at the bottom of each panel. The runners 14, 15 extend the length of each section 12. As shown, the door 10 is a made up of four such sections. Basically the doors have a fixed height, but can vary in width and as a result the sections 12 can be as narrow as 8 feet and as wide as 16 feet.

Figure 3:
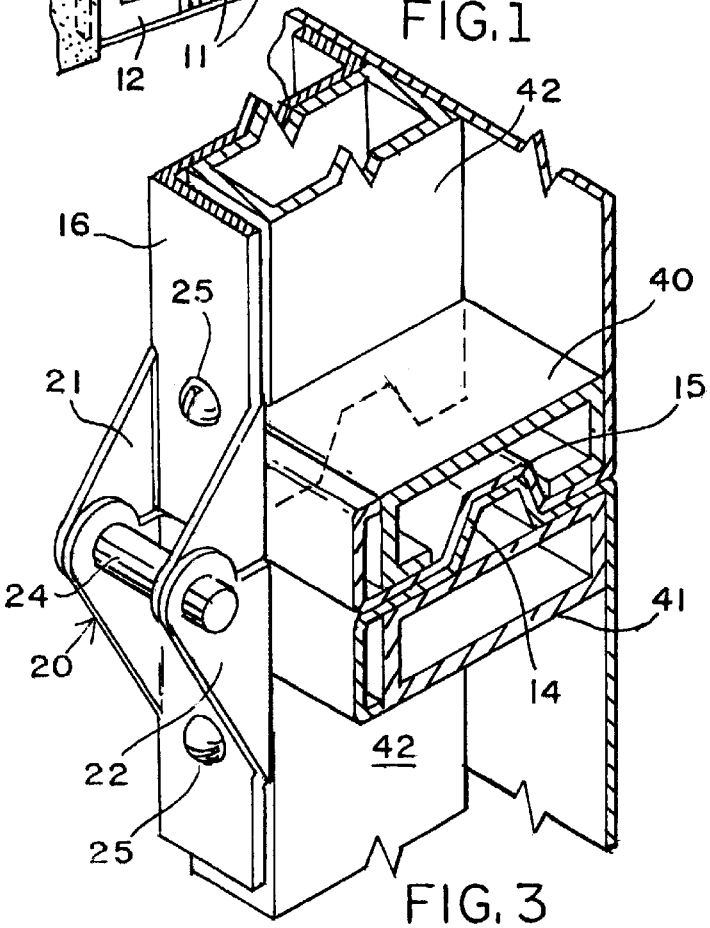
FIG. 3 is a broken perspective sectional view showing the typical hinge securing two adjacent raised pands together.
Figure 2:
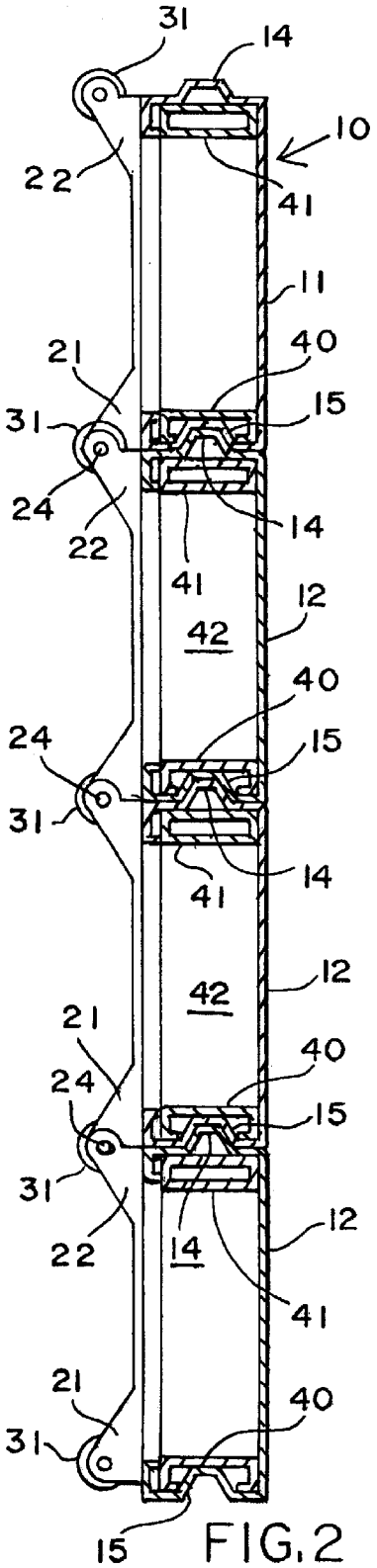
FIG. 2 is a transverse sectional view of the subject door taken along section lines 2—2 of FIG. 1.
Figure 4:
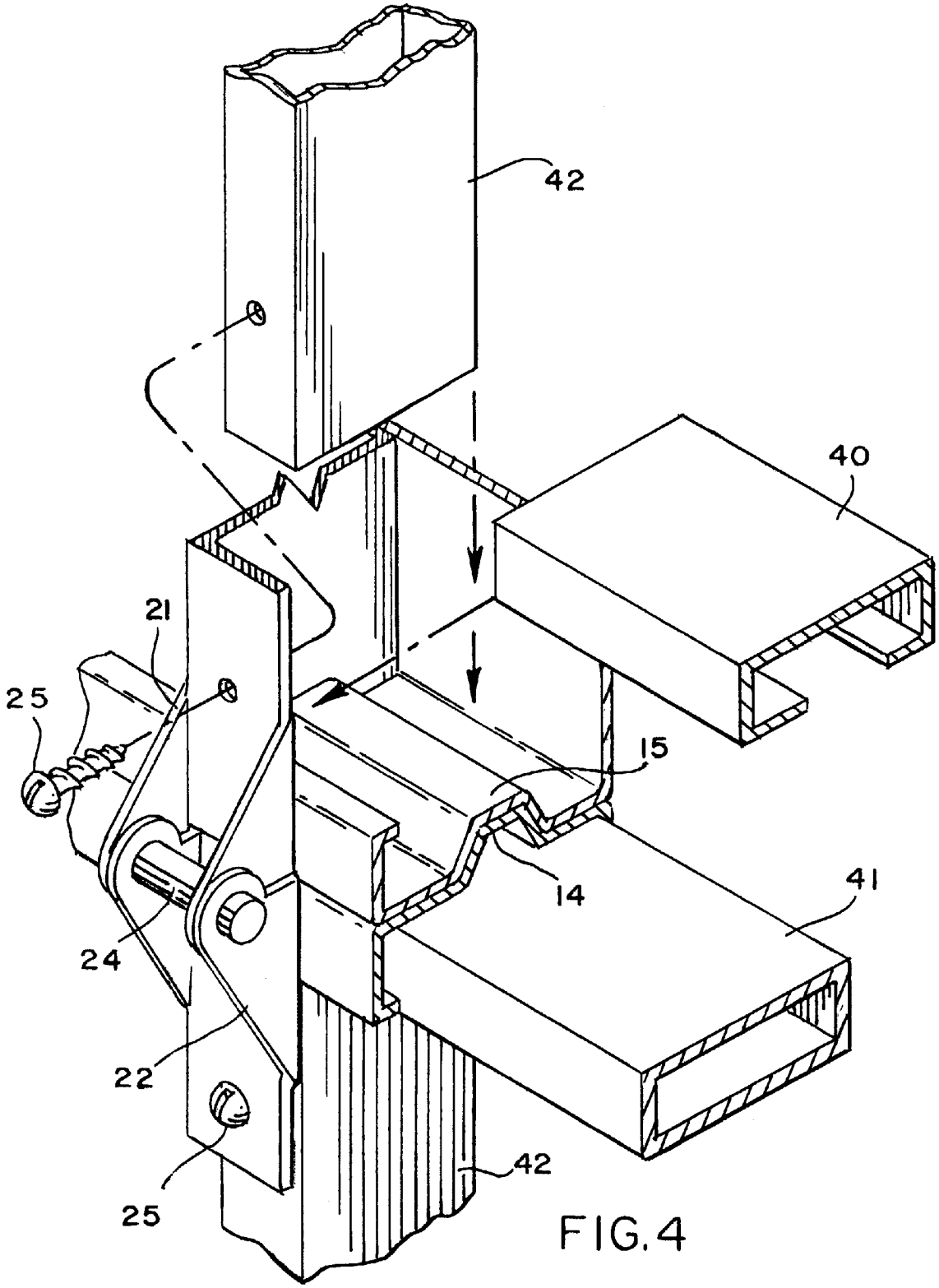
FIG. 4 is a view comparable to FIG. 3 but showing the reinforcing bars in exploded relationship.
Figure 5:
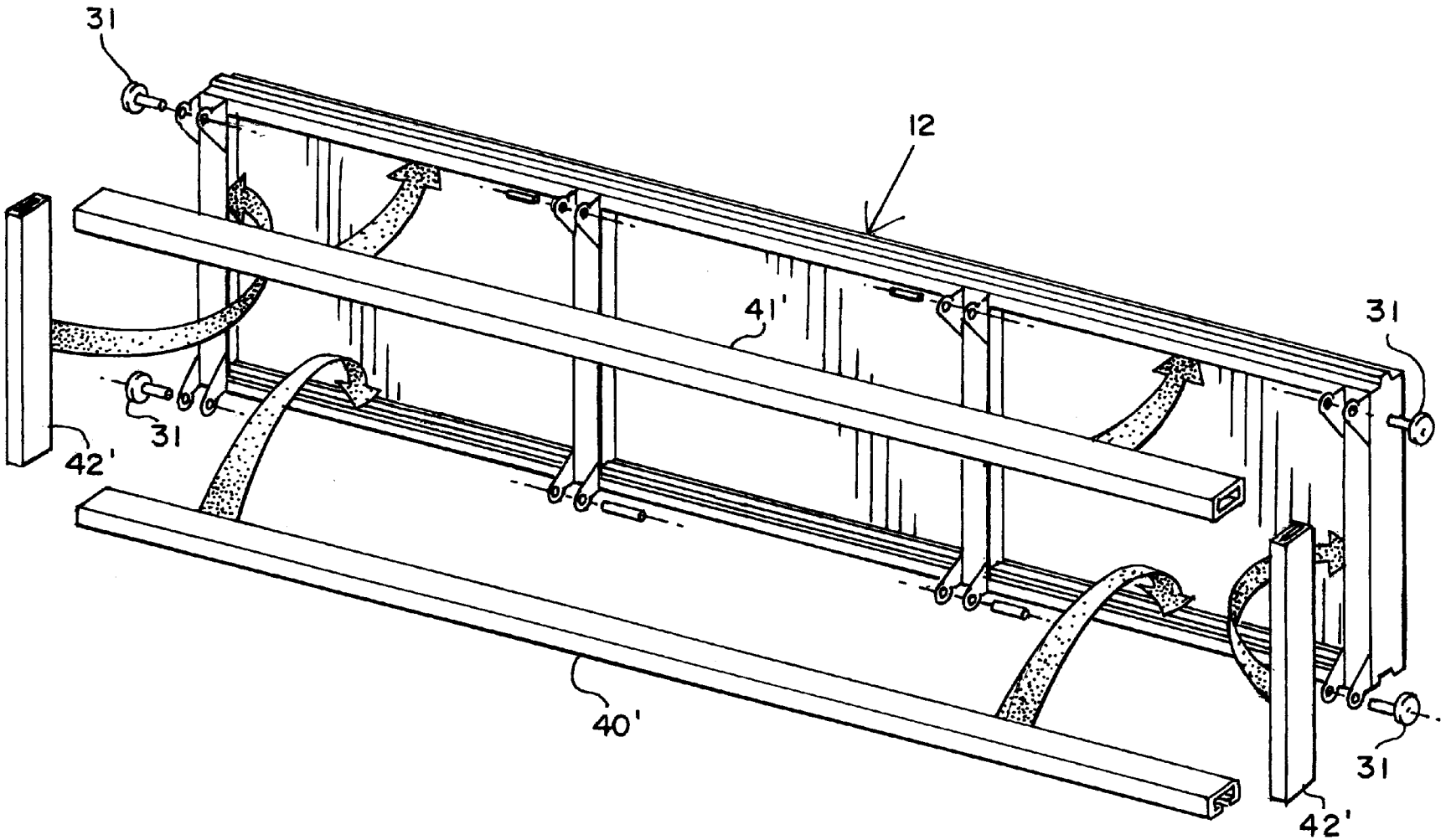
FIG. 5 is a further exploded view showing the relationship between the tongue bars, groove bars and stiles bars with the remaining portion of the door.
Figure 6:
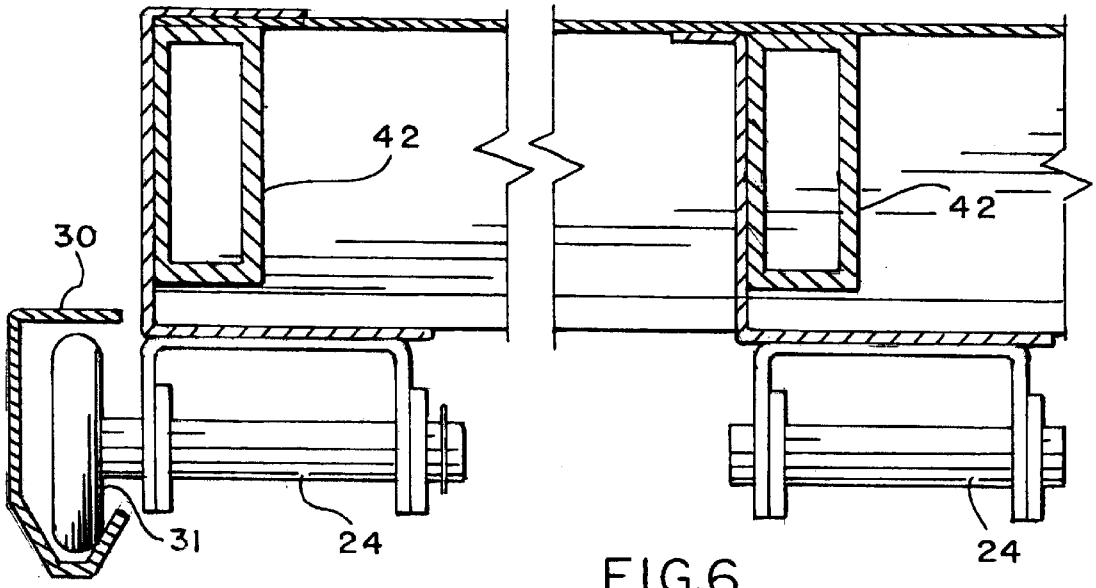
FIG. 6 is an enlarged broken transverse sectional view taken along section lines 6—6 of FIG. 1.
Figure 7:
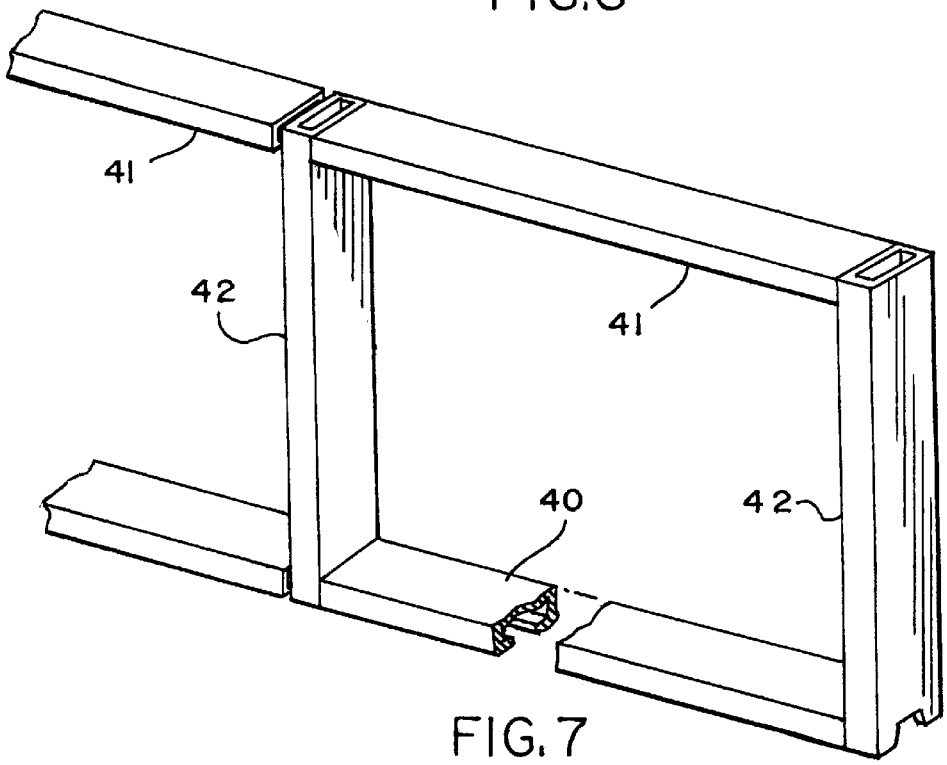
FIG. 7 is a further view showing the reinforcing bars as they relate to each other independently of the host door.

Turning now to FIG. 2, it will be seen that reinforcing bars are positioned horizontally, with the tongue bar 40 on top, and the groove bar 41 underneath the groove. Conversely stated, the tongue bar 40 is at the bottom of section 12 and the groove bar 41 is at the top of section 12. The sections, in turn, are joined by a hinge 20. Each hinge has an upper body 21 and a lower body 22, which are secured together by hinge pin 24. A plurality of self-taping screws 25 secure each of the upper and lower 21, 22 members to the adjacent panel. This is best shown in FIGS. 3 and 4. The balance of the reinforcement is a function of the stile bars 42, particularly as shown in FIG. 5. In the manufacturing process, the bars are positioned in place and secured by a commercial adhesive prior to applying the hinges 20. In a retrofit, on the other hand, the tongue bar 40 and groove bar 41 are dropped in place or raised in place and secured thereto by a commercial adhesive. The stile bars 42, in a retrofit, are notched as shown particularly in FIG. 7 so that they will pass by the self-taping sheet screws 25. Also as shown in FIG. 5, provision is made for end rollers 31 at the terminal ends of each section 12 to fit into the track 30, as shown in FIGS. 1 and 6.

In the smaller applications of garage doors, the stile bars 42 are primarily at the side edge of the door only. For higher wind requirements, the stile bars 42 can be inserted where each stile is located. In addition, as noted in FIGS. 9, 10, 11 and 12, reinforcing trusses 50 are fastened to the vertical stiles 16 at various locations. For example, FIG. 9 shows two such trusses positioned adjacent each other at the bottom of the panel. The reinforcements are 0.036 inch thickness 2 ¼ inch by 2 inch galvanized steel U-bar. They are secured to the stiles by self-taping screws or rivets. Similarly, a further reinforcing truss 50 is employed at the top of the panel, as shown in FIG. 12.

FIG. 10 discloses the utilization of the reinforcing trusses 50 as secured to the vertical stiles in an intermediate section. In this instance, the lower reinforcing truss is positioned as close as possible to the hinge 20. The upper reinforcing truss is spaced from the upper hinge 20.

As shown in FIG. 11, the reinforcing trusses 50 are positioned both in spaced relationship to the adjacent hinges 20. Finally, in FIG. 12, a single reinforcing truss 50 is employed at the lower portion of the upper section 12. Where maximum winds in excess of 100 mph. are the design criteria, the reinforcing trusses 50 are employed and shown in FIGS. 9, 10, 11 and 12. In addition, vertical stile bars 42 may optionally be employed to reinforce all of the stiles.

Figure 14C:
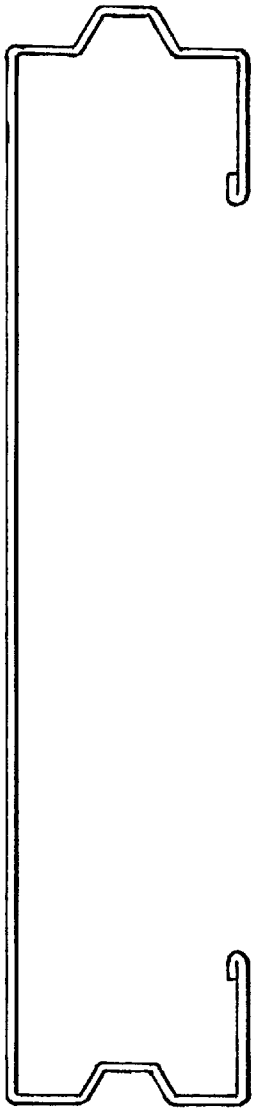

Alternatives are shown in FIGS. 8*a–w*, 14*a–c* and 15*a–d*. As will be seen in FIG. 8*a*, the extruded cross-section can take a wide variety of shapes. The preferred embodiment has already been shown and described, but for purposes of completeness, the alternatives such as FIG. 8*a* which is essentially an I-beam, and FIG. 8*w* which is essentially a Z-shaped, are all illustrated. Alternative form of the door panel 11 are shown in FIGS. 14*a, b* and *c*. In FIG. 14 roll formed with reversely bent edges. In FIG. 14*b* the same is provided with a face member which is roll seamed to the end of members. Finally, FIG. 14*c* shows yet another reversely folded form.

In FIGS. 15*a–d*, roll formed steel configurations for the groove bar, welded seam bar, U-shaped bar and unwelded seam bar 15*a, b, c* and *d* are shown.

The method of retrofit is as straight forward as the explanation above of the tongue bars 40, groove bars 41, and stiles 42. No particular sequence is essential to the positioning other than placing the stile bars 42 in place first. Once the stile bars are in place, then the tongue bar 40 and the groove bar 41 are positioned opposite each other in opposite sections 12 in a budding relationship to the stile bar 42. Optionally, the tongue bar 40 and the groove bar 41 can extend to abut the ends of the door stiles with the stile bar 42 being dropped in on to of and beneath the tongue bar 40 and groove bar 41.

As set forth above, different cross-sections of the reinforcing bars 40, 41 and 42 are contemplated. For example, as shown in FIG. 8, they can take the configuration of a flat bar, channel, C-channel, opposed L-shaped channels, and even formed with mating tongue and groove sections. The same can be roll-formed out of steel, or break-formed out sheet steel, or extruded aluminum. In each instance, the thrust of the utilization of the reinforcing bars is to provide an interior reinforcing bar 40, 41, 42 at each panel 11 of each section 12.

It will be understood that various changes in the details, materials and arrangements of parts, or method which have been herein described and illustrated in order to explain the nature of the invention, may be made by those skilled in the art within the principle and scope of the invention as expressed in the appended claims.

What is claimed is:

1. A reinforced garage door in which said garage door has a plurality of horizontal panels, having a horizontal width and a vertical height, which panels are monolithic for the entire length of the panels, with adjacent panels above such panels having reversely folded edge portions with a tongue and a groove joint along the top edge and the bottom edge, such panels having open end members, open reinforcing members spaces vertically and interiorly of the door, and means for securement at the extreme lateral edges to a track for raising and lowering the door, the improvement comprising:

a plurality of longitudinal unitary reinforcement insertable horizontally and interiorly of the tongue and the groove top and bottom longitudinal reversely folded edge portions of the panel from one end thereof to the other uninterrupted by any vertical reinforcement members;

a plurality of reinforcement members positioned vertically at the lateral edges of the subject panel; and all of said reinforcement members framing a given reinforced area along the height and width of each panel;

whereby a standard garage door is reinforced around the edges of its various reinforced members by reinforcement bars positioned to retrofit the openings.

2. A method for reinforcing a garage door having a plurality of horizontal panels, monolithic of the entire length of the panels, with adjacent panels above or below such panels having reversely folded tongue and groove joints along the top edge and the bottom edge, such panels having open end members, open reinforcing stile members spaces vertically and interiorly of the door, and means for securement at the extreme lateral edges to track for raising and lowering the door, the steps of which comprising:

forming a plurality of unitary reinforcing members positioned to nestle horizontally at the top edge and bottom edge of each such panel in the reversely folded portion of such edges;

forming a unitary reinforcing member to nestle in the uninterrupted longitudinal edge of the subject panel and positioning it in place; and forming a plurality of stile reinforcing member vertically oriented at the lateral vertical edges and intermediate reinforcing members in the panel;

whereby placing the subject reinforcing members into a door panel can be done as a step of the original manufacturing or retrofitting such a door for reinforcement to gain additional straight.

3. In the garage door according to claim 1, said extrusions being formed of aluminum; and said extrusions having substantially right-angled corners throughout their cross-sections.

* * * * *